US011761059B2

(12) United States Patent
Zhao et al.

(10) Patent No.: US 11,761,059 B2
(45) Date of Patent: Sep. 19, 2023

(54) PREPARATION METHOD OF IN-SITU TERNARY NANOPARTICLE-REINFORCED ALUMINUM MATRIX COMPOSITE

(71) Applicant: Jiangsu University, Jiangsu (CN)

(72) Inventors: Yutao Zhao, Jiangsu (CN); Liwei Jin, Jiangsu (CN); Wei Qian, Jiangsu (CN); Xizhou Kai, Jiangsu (CN); Xu Gao, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/627,812

(22) PCT Filed: Nov. 5, 2020

(86) PCT No.: PCT/CN2020/126671
§ 371 (c)(1),
(2) Date: Jan. 18, 2022

(87) PCT Pub. No.: WO2021/114967
PCT Pub. Date: Jun. 17, 2021

(65) Prior Publication Data

US 2022/0251683 A1 Aug. 11, 2022

(30) Foreign Application Priority Data

Dec. 10, 2019 (CN) ..... 201911261111.7

(51) Int. Cl.
*C22C 1/10* (2023.01)
*C22F 1/04* (2006.01)
(Continued)

(52) U.S. Cl.
CPC ..... *C22C 1/1036* (2013.01); *C22C 1/1068* (2013.01); *C22C 21/00* (2013.01);
(Continued)

(58) Field of Classification Search
None
See application file for complete search history.

(56) References Cited

FOREIGN PATENT DOCUMENTS

| | | |
|---|---|---|
| CN | 101417388 | 4/2009 |
| CN | 103075445 | 5/2013 |

(Continued)

OTHER PUBLICATIONS

"Office Action of China Counterpart Application" with English translation thereof, dated Feb. 1, 2021, p. 1-p. 17.

(Continued)

*Primary Examiner* — George Wyszomierski
*Assistant Examiner* — Janell C Morillo
(74) *Attorney, Agent, or Firm* — JCIPRNET

(57) ABSTRACT

The present invention provides a method for preparing an in-situ ternary nanoparticle-reinforced aluminum matrix composite (AMC). In this method, an in-situ reaction generation technique is used, and with a powder containing formation elements for producing reinforcing particles as a reactant, in conjunction with a low-frequency rotating magnetic field/ultrasonic field regulation technique, an aluminum-based composite material is prepared using nanoparticle intermediate alloy re-melting. An AA6016-based composite material reinforced by ternary nanoparticles has an average particle size of 65 nm, and has an obvious refinement phenomenon compared with unitary and dual-phase nanoparticles.

4 Claims, 3 Drawing Sheets

(a)

(b)

(51) Int. Cl.
*C22C 32/00* (2006.01)
*C22C 21/00* (2006.01)

(52) U.S. Cl.
CPC ..... *C22C 32/0005* (2013.01); *C22C 32/0047* (2013.01); *C22F 1/04* (2013.01); *C22C 1/1052* (2023.01)

(56) References Cited

FOREIGN PATENT DOCUMENTS

| | | | | | |
|---|---|---|---|---|---|
| CN | 108559864 | | | 9/2018 | |
| CN | 109234561 | | | 1/2019 | |
| CN | 109234561 | A | * | 1/2019 | ..... C22C 1/1036 |
| CN | 109234562 | | | 1/2019 | |
| CN | 109504870 | | | 3/2019 | |
| CN | 109530468 | | | 3/2019 | |
| CN | 109957685 | | | 7/2019 | |
| CN | 110016582 | | | 7/2019 | |
| CN | 110016585 | | | 7/2019 | |
| CN | 111206166 | | | 5/2020 | |
| GB | 2590288 | A | * | 6/2021 | ..... B21C 23/001 |
| WO | 9835069 | | | 8/1998 | |

OTHER PUBLICATIONS

"International Search Report (Form PCT/ISA/210)" of PCT/CN2020/126671, dated Jan. 27, 2021, pp. 1-6.

* cited by examiner (a)

(b)

PREPARATION METHOD OF IN-SITU TERNARY NANOPARTICLE-REINFORCED ALUMINUM MATRIX COMPOSITE

CROSS-REFERENCE TO RELATED APPLICATION

This application is a 371 of international application of PCT application serial no. PCT/CN2020/126671, filed on Nov. 5, 2020, which claims the priority benefit of China application no. 201911261111.7, filed on Dec. 10, 2019. The entirety of each of the above mentioned patent applications is hereby incorporated by reference herein and made a part of this specification.

BACKGROUND

Technical Field

The present invention provides a preparation method of an in-situ ternary nanoparticle-reinforced aluminum matrix composite (AMC), and belongs to the technical field of AMC preparation.

Description of Related Art

In recent years, as the environmental pollution and energy shortage issues have become increasingly prominent and the demand for lightweight automobile manufacturing has increased, high-tech fields such as aerospace, rail transit, and new energy vehicles show huge demand potential for in-situ AMCs and present higher and higher requirements on the comprehensive performance of in-situ AMCs. Therefore, further improving the comprehensive mechanical properties and shape processing properties of in-situ AMCs has become an urgent problem to be solved at present.

In-situ particle-reinforced AMCs are prepared as follows: adding a solid powder reaction salt with elements for forming reinforcement phase particles to a surface of a molten aluminum alloy at a specified temperature, and stirring to allow a complete reaction to generate reinforcement particles in the aluminum melt. Compared with materials prepared by traditional synthesis techniques, in-situ composites have the following characteristics: (1) Since reinforcement particles are thermodynamically stable phases formed due to in-situ nucleation and growth from a matrix, the reinforcement particles will not be decomposed or converted into other compounds at high temperatures. (2) By rationally selecting the types and compositions of compounds, the type, size, and quantity of an in-situ reinforcement can be effectively controlled. (3) In-situ endogenous particles are well bonded to a matrix interface, have a smaller size than external particles, and are prone to uniform distribution in an aluminum matrix, such that the elasticity modulus and tensile strength of an in-situ AMC are significantly improved. However, such a technique is not perfect enough, which is mainly manifested in the following aspects: (1) There are few reaction systems. The Al—Ti-x (Al—Ti—O, Al—Ti—B) system is mostly adopted, but the system requires a high reaction temperature, which not only makes it difficult to control the morphology of a reinforcement phase synthesized by the reaction, but also severely deteriorates an aluminum melt. (2) Nanoparticles have a small size, and thus the specific surface area (SSA) effect is very obvious, which makes particles easy to agglomerate and difficult to disperse in an aluminum melt. (3) The wettability of particles to a matrix is poor, and the yield of binary nanoparticles is low.

Investigation of existing technical literatures and review literatures shows that some progress has been made for in-situ dual-phase nanoparticles. For example, in Chinese patent 201811286812.1, the Zr and $H_3BO_3$ system is used to prepare $ZrB_2$ and $Al_2O_3$ dual-phase reinforcement nanoparticles through a melt direct reaction technology in combination with an electromagnetic control technology, which avoids uneven particle distribution and leads to square $ZrB_2$ particles and round $Al_2O_3$ particles that are uniformly distributed and have a size of 50 nm to 100 nm. After the composite is subjected to a T6 heat treatment, its strength is increased by 23.4%, its elongation at break is increased by 62%, and its shock resistance is increased by 38%. In Chinese Patent 201811286813.6, borax ($Na_2B_4O_7$) and potassium fluorozirconate ($K_2ZrF_6$) powders are used as a mixed reaction salt to prepare $ZrB_2$ and $Al_2O_3$ dual-phase reinforcement nanoparticles; an aluminum alloy smelting process is controlled by mechanical stirring and a rare earth intermediate alloy is added to refine matrix grains; an in-situ reaction process of a composite is controlled by acousto-magneto coupling; and ultrasonic vibration is applied during a solidification process, such that binary nanoparticles have a small size and are distributed uniformly, and the strength and toughness of the composite are significantly improved. At present, nanoparticle reinforcement phases prepared by in-situ reactions are mainly concentrated on unary particles, but there are rare related literature reports on the preparation of a multi-nanoparticle-reinforced AMC by an in-situ melt reaction. Therefore, there is an urgent need to develop a novel reaction system and method to prepare multiple nanoparticles and improve the particle yield.

SUMMARY

The present invention is intended to overcome the shortcomings in the prior art and provide a preparation method of an in-situ ternary nanoparticle-reinforced AMC. In the method, through the combination of an electromagnetic control technology and an ultrasonic dispersion technology, $TiB_2$ reinforcement particles are added as an intermediate alloy to ($ZrB_2$+$Al_2O_3$) nanoparticle-reinforced AA6111-based composite to prepare a high-strength and high-modulus ternary nanoparticle-reinforced AMC that has fine grains, uniform particle dispersion, and a particle size controlled at 20 nm to 80 nm.

The preparation method of the in-situ ($ZrB_2$+$Al_2O_3$+$TiB_2$) nanoparticle-reinforced AA6111-based composite of the present invention adopts a two-step reaction, where the low-frequency rotating magnetic field technology and the ultrasonic control technology are combined to add $TiB_2$ reinforcement particles as an intermediate alloy to the ($ZrB_2$+$Al_2O_3$) nanoparticle-reinforced AA6111-based composite, and the obtained composite includes three nanoparticle reinforcement phases of $ZrB_2$, $Al_2O_3$, and $TiB_2$. The multi-particle-reinforced AMC has better physical and chemical properties than a single-particle-reinforced AMC. The interaction among multiple particles can effectively improve the wettability of the particles to the matrix, increase the interfacial bonding strength (IBS) between the particles and the matrix, and significantly improve the structure and performance of the composite. $TiB_2$ and $ZrB_2$ particles are metalloid compounds of the hexagonal crystal system, which have high stability, high melting point, low coefficient of thermal expansion (CTE), high elasticity modulus, and high temperature strength, and both Ti and B elements can refine grains. $Al_2O_3$ particles have a very stable size and a high hardness, and show prominent chemical compatibility with the matrix, such that there will be no interfacial chemical reaction. The $ZrB_2$, $Al_2O_3$, and $TiB_2$ nanoparticles produced in the present invention have stable thermodynamic properties and high melting points, and thus will not be decomposed in a high-temperature environment.

Specific steps of the technical solution adopted by the present invention are as follows.

(1) The present invention adopts borax ($Na_2B_4O_7 \cdot 10H_2O$), potassium fluoroborate ($KBF_4$), potassium fluorozirconate ($K_2ZrF_6$), and potassium fluorotitanate ($K_2TiF_6$) as reaction salts, and an industrial pure aluminum and an AA6111 alloy as matrices. Powders of the reaction salts are dried at 200° C. to 250° C. for 2 h to 3 h, the $KBF_4$ reaction salt and the $K_2TiF_6$ reaction salt are weighed at an amount enough to form a 5 wt. % $TiB_2$ reinforcement particle-containing intermediate alloy and thoroughly mixed to obtain a $KBF_4/K_2TiF_6$ mixed reaction salt powder, the $K_2ZrF_6$ reaction salt and the borax ($Na_2B_4O_7 \cdot 10H_2O$) reaction salt are weighed at an amount of 1% to 3% of a volume fraction of ($ZrB_2+Al_2O_3$) in the finally-formed in-situ ($ZrB_2+Al_2O_3+TiB_2$) nanoparticle-reinforced AA6111-based composite and thoroughly mixed to obtain a $K_2ZrF_6$/borax mixed reaction salt powder, and the $KBF_4/K_2TiF_6$ mixed reaction salt powder and the $K_2ZrF_6$/borax mixed reaction salt powder are each wrapped with an aluminum foil for a later use.

(2) Preparation of a $TiB_2$ reinforcement particle-containing intermediate alloy: the weighed industrial pure aluminum is placed in a preheated crucible for melting by heating to 830° C. to 870° C., to obtain a resulting aluminum melt; the weighed $KBF_4/K_2TiF_6$ mixed reaction salt powder is added to the resulting aluminum melt, and after the weighed $KBF_4/K_2TiF_6$ mixed reaction salt powder is completely added, an acousto-magneto coupling field is applied for a reaction; and after the reaction is conducted at 850° C. for 30 min to obtain a first melt, the first melt is cooled to 730° C. to 750° C., and subjected to refining, slag removal, and casting with a copper mold to obtain a wedge-shaped ingot for a later use, which is the $TiB_2$ reinforcement particle-containing intermediate alloy.

In step (2), in the $TiB_2$ reinforcement particle-containing intermediate alloy obtained after the casting, a proportion of the $TiB_2$ particles is 5% (mass fraction), with the balance being Al.

(3) Preparation of a ($ZrB_2+Al_2O_3+TiB_2$) nanoparticle-reinforced AA6111-based composite: the weighed AA6111 aluminum alloy is placed in a preheated graphite crucible for melting by heating to 830° C. to 870° C., to obtain a resulting AA6111 aluminum alloy melt; the weighed $K_2ZrF_6$/borax mixed reaction salt powder is added to the resulting AA6111 aluminum alloy melt, and after the weighed $K_2ZrF_6$/borax mixed reaction salt powder is completely added, the acousto-magneto coupling field is applied for a reaction; after the reaction is conducted at 850° C. for 15 min to obtain a second melt, the second melt is subjected to refining and slag removal; after the second melt is cooled to 750° C., the pre-weighed $TiB_2$ reinforcement particle-containing intermediate alloy is added to the second melt; after the $TiB_2$ reinforcement particle-containing intermediate alloy is completely melted, the acousto-magneto coupling field is applied, followed by incubating for 15 min to 20 min to obtain a third melt; and the third melt is subjected to refining, slag removal, and casting with a copper mold to obtain the ($ZrB_2+Al_2O_3+TiB_2$) nanoparticle-reinforced AA6111-based composite.

Parameters of the acousto-magneto coupling field in step (3) are the same as those in step (2), and the $TiB_2$-containing intermediate alloy is weighed at an amount that allows a weight percentage of the $TiB_2$ in the ($ZrB_2+Al_2O_3+TiB_2$) nanoparticle-reinforced AA6111-based composite to be 1 wt. % to 3 wt. %.

The obtained composite is subjected to a T6 heat treatment, where the T6 heat treatment includes a solid solution treatment and an aging treatment. The solid solution treatment is conducted as follows: heating from room temperature to 545° C. to 550° C., keeping at the temperature for 2.5 h to 43 h, and quenching in a water bath at a temperature not higher than 30° C., with a quenching transfer time of less than 10 s; and the aging treatment is conducted as follows: heating from room temperature to 160° C. to 180° C., keeping at the temperature for 6 h to 8 h, and furnace-cooling.

The parameters of the acousto-magneto coupling field include: excitation current of 200 A to 250 A; magnetic field frequency of 15 Hz to 20 Hz; ultrasonic power of 1.5 Kw to 2 Kw; and ultrasonic frequency of 20 KHz to 30 KHz.

The present invention provides a preparation method of an in-situ ($ZrB_2+Al_2O_3+TiB_2$) ternary nanoparticle-reinforced AMC, and belongs to the technical field of AMC preparation. The method adopts a two-step melt reaction, where the low-frequency rotating magnetic field technology and the ultrasonic field control technology are combined to prepare the AMC through re-melting the reinforcement nanoparticle-containing intermediate alloy. The present invention mainly has the following advantages.

(1) The ternary nanoparticle ($ZrB_2+Al_2O_3+TiB_2$)-reinforced AMC is prepared through an in-situ reaction technology, where there is well interfacial bonding between the particles and the matrix, a clean and pollution-free interface, and no interfacial reaction, which overcomes the problems that particles generated by a traditional addition method show poor wettability to a matrix and there are interfacial reactions.

(2) The $TiB_2$ reinforcement particles are added as an intermediate alloy to the ($ZrB_2+Al_2O_3$) nanoparticle-reinforced AA6111-based composite, which avoids by-products caused by the addition of too many kinds of reaction salts in the reaction system, and overcomes the problem that side reactions caused by the excessive addition of reaction salts, the difficult control of a reaction process, the excessive addition of reaction salts, and the too-long reaction time aggravate the melting loss of molten aluminum.

(3) The acousto-magneto coupling external field has the advantages of a magnetic field and an ultrasonic field. Under the action of acoustic cavitation, acoustic streaming, and rotating magnetic field stirring of the ultrasonic field, grains in the matrix structure become fine and round, and reinforcement particles are uniformly distributed in the matrix and have a small size. Under the combined action of the magnetic field and the ultrasonic field, the size, morphology, and distribution of the nanoparticles are improved.

(4) The particle size, distribution, and quantity of $ZrB_2$, $Al_2O_3$, and $TiB_2$ particle reinforcement phases prepared through an in-situ reaction are controllable.

BRIEF DESCRIPTION OF THE DRAWINGS

In order to explain the technical solutions of the present invention more clearly, accompanying drawings that need to be used will be briefly introduced below. Apparently, the accompanying drawings in the following description show merely some examples of the present invention, and other drawings may be derived from these accompanying drawings by a person of ordinary skill in the art without creative efforts.

(a) of FIG. 1 shows optical microscopy (OM) images of the matrix, and (b) of FIG. 1 shows optical microscopy images of the 1 vol % $ZrB_2$+1 vol % $Al_2O_3$+1 wt % $TiB_2$.

DESCRIPTION OF THE EMBODIMENTS

Figure 1:
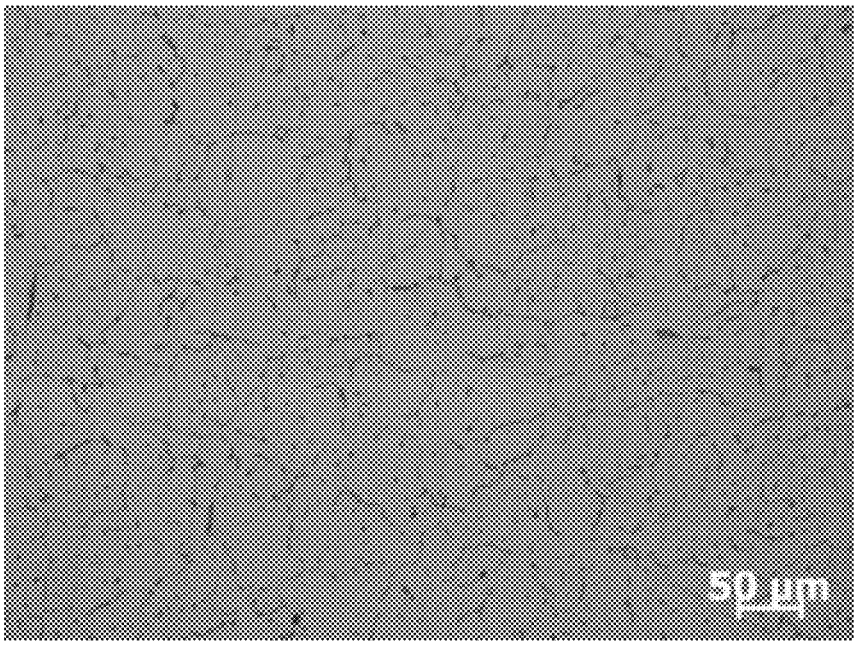
Figure 1:
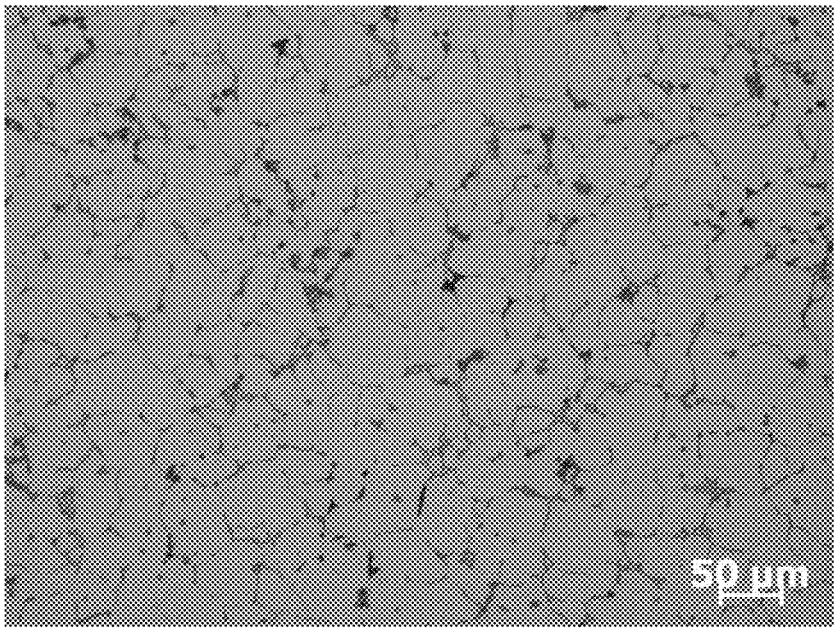

The present invention can be implemented according to the following examples, but is not limited to the following examples. Unless otherwise specified, the terms used in the present invention generally have the meanings commonly understood by those of ordinary skill in the art. It should be understood that these examples are used merely to illustrate the present invention rather than limit the scope of the present invention in any way. In the following examples, various processes and methods that are not described in detail are conventional methods known in the art.

Example 1

Preparation of a 1 Vol. % $ZrB_2$+1 Vol. % $Al_2O_3$+1 wt. % $TiB_2$ Nanoparticle-Reinforced AMC A two-step melt reaction method was adopted. Step 1: Preparation of a 5 wt. % $TiB_2$ particle-reinforced AMC: $K_2BF_6$ and $K_2TiF_6$ powders were used as reactants, and dried at 200° C. for 120 min in a drying box to remove crystal water. Then the composition design was conducted according to a $TiB_2$ nanoparticle mass fraction of 5%. 254.91 g of dried potassium fluoroborate and 246.10 g of potassium fluorotitanate were weighed, thoroughly mixed, and wrapped with aluminum foil for later use. 886.25 g of industrial pure aluminum was weighed and heated to 850° C. in a high-frequency induction heating furnace, then the mixed reaction salt was pressed into the resulting melt using a graphite bell jar, and an acousto-magneto coupling field was applied at an excitation current of 200 A, a magnetic field frequency of 15 Hz, an ultrasonic power of 1.8 Kw, and an ultrasonic frequency of 20 KHz to allow a reaction. After the reaction was conducted for 30 min at the temperature, the melt was cooled to 750° C., and then subjected to refining, slag removal, and casting at 720° C. to obtain a wedge-shaped ingot, which was the $TiB_2$ reinforcement particle-containing intermediate alloy. Step 2: Preparation of a ($ZrB_2$+$Al_2O_3$) nanoparticle-reinforced AA6111-based composite: The composition design was conducted according to a nanoparticle ($ZrB_2$+$Al_2O_3$) volume fraction of 1%. 1,328.64 g of an AA6111 aluminum alloy, 48.77 g of borax ($Na_2B_4O_7 \cdot 10H_2O$), and 113.88 g of potassium fluorozirconate ($K_2ZrF_6$) were weighed. The weighed AA6111 aluminum alloy was heated to 850° C. in a high-frequency induction heating furnace for melting, then the weighed $K_2ZrF_6$ and borax were added to the resulting aluminum melt in multiple batches, and after the reaction salt powder was completely added, an acousto-magneto coupling field was applied to allow a reaction for 15 min. The resulting melt was subjected to refining and slag removal. After the melt was cooled to 750° C., the pre-weighed (245.6 g) $TiB_2$-containing intermediate alloy was added to the melt, and an acousto-magneto coupling field was applied to allow a reaction for 15 min. The resulting melt was subjected to refining, slag removal, and casting at 720° C. to obtain the 1 vol. % $ZrB_2$+1 vol. % $Al_2O_3$+1 wt. % $TiB_2$ nanoparticle-reinforced AMC.

The obtained composite ingot was processed into a standard tensile specimen, and then the tensile specimen was subjected to a T6 heat treatment, where the solid solution treatment was conducted as follows: heating from room temperature to 550° C. and keeping at the temperature for 3 h, and the aging treatment was conducted as follows: heating from room temperature to 160° C., keeping at the temperature for 8 h, and furnace-cooling.

Figure 4:
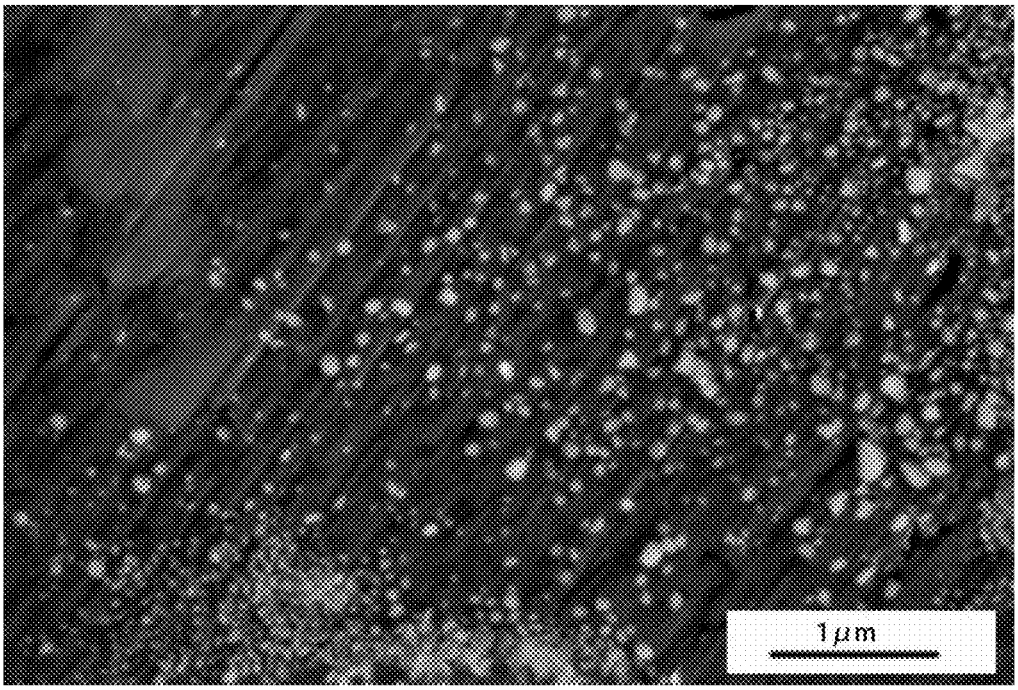
FIG. 4 is an SEM image of the 1 vol. % $ZrB_2$+1 vol. % $Al_2O_3$+1 wt. % $TiB_2$ ternary particles prepared in the present invention.

It can be seen from FIG. 1 and FIG. 4 that, compared with the matrix grains, a grain structure of the composite is refined and has a relatively uniform size, the particles have a small size and are uniformly distributed, and there is no obvious particle agglomeration, which improves the strength and plasticity of the material. Results of the room-temperature mechanical performance test show that the composite prepared by the method of the present invention has a tensile strength of 343.6 MPa and an elongation at break of 22.87%.

Example 2

Preparation of a 2 Vol. % $ZrB_2$+2 Vol. % $Al_2O_3$+2 wt. % $TiB_2$ Nanoparticle-Reinforced AMC A two-step melt reaction method was adopted: Step 1: An AMC with 5 wt. % $TiB_2$ reinforcement particles was prepared, and the composition design was conducted according to a $TiB_2$ nanoparticle mass fraction of 5%. The composite was used as a nanoparticle-containing intermediate alloy. Step 2: Preparation of a ($ZrB_2$+$Al_2O_3$) nanoparticle-reinforced AA6111-based composite: The composition design was conducted according to a nanoparticle ($ZrB_2$+$Al_2O_3$) volume fraction of 2%. 1,218.64 g of an AA6111 aluminum alloy, 96.31 g of borax ($Na_2B_4O_7 \cdot 10H_2O$), and 224.89 g of potassium fluorozirconate ($K_2ZrF_6$) were weighed. The weighed AA6111 aluminum alloy was heated to 850° C. in a high-frequency induction heating furnace for melting, then the weighed $K_2ZrF_6$ and borax were added to the resulting aluminum melt in multiple batches, and after the reaction salt powder was completely added, an acousto-magneto coupling field was applied to allow a reaction for 15 min. The resulting melt was subjected to refining and slag removal. After the melt was cooled to 750° C., the pre-weighed (487.46 g) $TiB_2$-containing intermediate alloy was added to the melt, and an acousto-magneto coupling field was applied to allow a reaction for 15 min. The resulting melt was subjected to refining, slag removal, and casting at 720° C. to obtain the 2 vol. % $ZrB_2$+2 vol. % $Al_2O_3$+2 wt. % $TiB_2$ nanoparticle-reinforced AMC.

The obtained composite ingot was processed into a standard tensile specimen, and then the tensile specimen was subjected to a T6 heat treatment, where the solid solution treatment was conducted as follows: heating from room temperature to 550° C. and keeping at the temperature for 3 h, and the aging treatment was conducted as follows: heating from room temperature to 160° C., keeping at the temperature for 8 h, and furnace-cooling.

Figure 2:
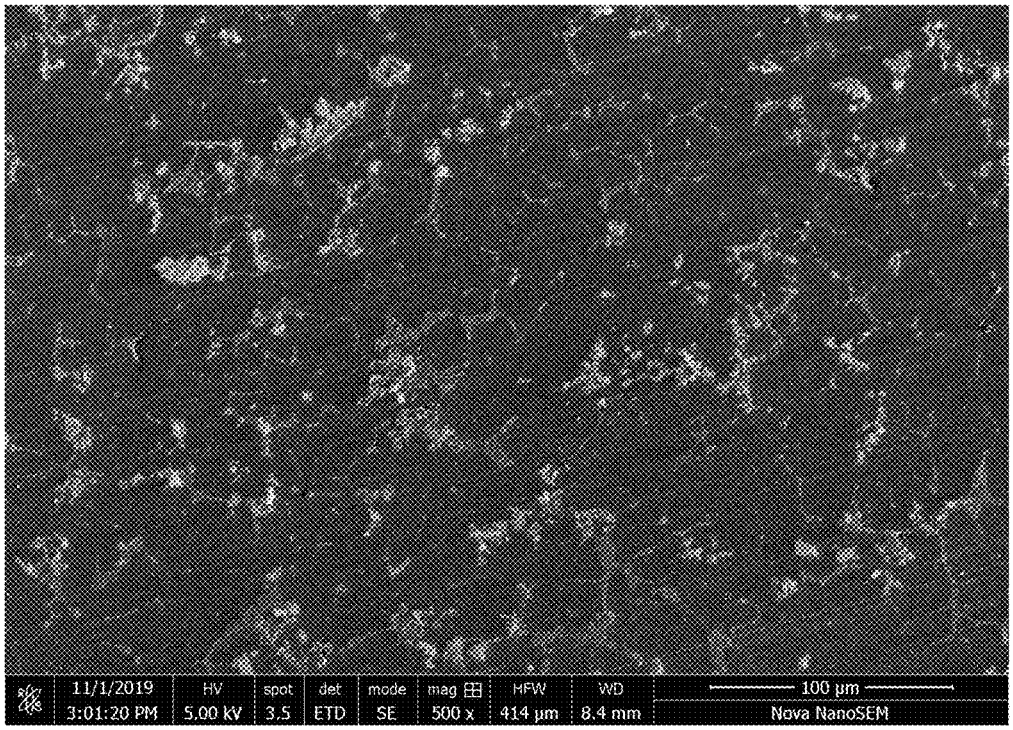
FIG. 2 is a scanning electron microscopy (SEM) image of the 2 vol. % $ZrB_2$+2 vol. % $Al_2O_3$+2 wt. % $TiB_2$ ternary nanoparticles obtained in the present invention.
Figure 3:
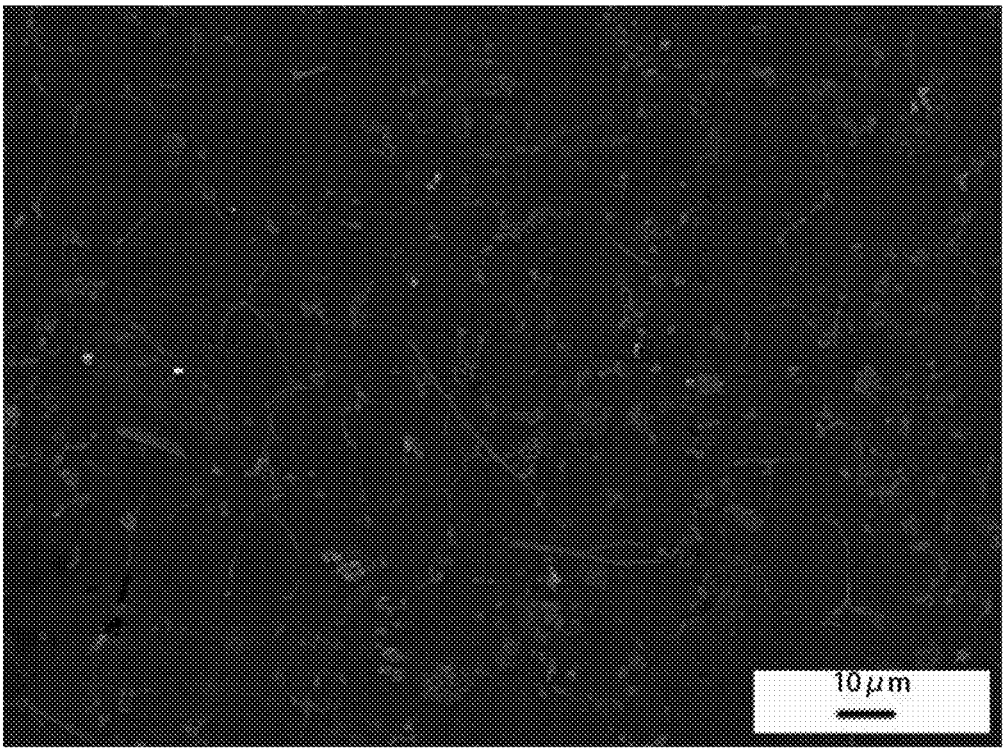
FIG. 3 is an SEM image of the 2 vol. % $ZrB_2$+2 vol. % $Al_2O_3$ binary nanoparticles prepared through an in-situ reaction.

It can be seen from FIG. 2 and FIG. 3 that, compared with binary particles, the ternary particle-reinforced AMC prepared by the present invention has a high particle yield, and because $TiB_2$ particles are added as an intermediate alloy, the IBS between the particles and the matrix is high, the surface of the material is clean, and the strength and plasticity of the composite are significantly improved. Results of the room-temperature mechanical performance test show that the composite prepared by the method of the present invention has a tensile strength of 368.41 MPa and an elongation at break of 24.6%.

Example 3

Preparation of a 3 Vol % $ZrB_2$+3 Vol % $Al_2O_3$+2 wt % $TiB_2$ Nanoparticle-Reinforced AMC A two-step melt reaction method was adopted. Step 1: An AMC with 5 wt. % $TiB_2$ reinforcement particles was prepared, and the composition design was conducted according to a $TiB_2$ nanoparticle mass fraction of 5%. The composite was used as a nanoparticle-containing intermediate alloy. Step 2: Preparation of a ($ZrB_2$+$Al_2O_3$) nanoparticle-reinforced AA6111-based composite: The composition design was conducted according to a nanoparticle ($ZrB_2$+$Al_2O_3$) volume fraction of 3%. 1,354.62 g of an AA6111 aluminum alloy, 159.87 g of borax ($Na_2B_4O_7 \cdot 10H_2O$), and 373.30 g of potassium fluorozirconate ($K_2ZrF_6$) were weighed. The weighed AA6111 aluminum alloy was heated to 850° C. in a high-frequency induction heating furnace for melting, then the weighed $K_2ZrF_6$ and borax were added to the resulting aluminum melt in multiple batches, and after the reaction salt powder was completely added, an acousto-magneto coupling field was applied to allow a reaction for 15 min. The resulting melt was subjected to refining and slag removal. After the melt was cooled to 750° C., the pre-weighed (541.84 g) nano $TiB_2$-containing intermediate alloy was added to the melt, and an acousto-magneto coupling field was applied to allow a reaction for 15 min. The resulting melt was subjected to refining, slag removal, and casting at 720° C. to obtain the 3 vol. % $ZrB_2$+3 vol. % $Al_2O_3$+2 wt. % $TiB_2$ nanoparticle-reinforced AMC.

The obtained composite ingot was processed into a standard tensile specimen, and then the tensile specimen was subjected to a T6 heat treatment, where the solid solution treatment was conducted as follows: heating from room temperature to 550° C. and keeping at the temperature for 3 h, and the aging treatment was conducted as follows: heating from room temperature to 160° C., keeping at the temperature for 8 h, and furnace-cooling.

The tensile properties were determined in accordance with an ASTM E8M-09 experimental standard test at a tensile rate of 1 mm/min and room temperature. Results of the room-temperature mechanical performance test show that the composite prepared by the method of the present invention has a tensile strength of 352.84 MPa and an elongation at break of 21.3%.

What is claimed is:

1. A preparation method of an in-situ ternary nanoparticle-reinforced aluminum matrix composite, comprising a two-step method:

step I: adding a reaction mixed salt with elements for forming $TiB_2$ reinforcement particles to a molten aluminum melt, while applying an acousto-magneto coupling field to prepare an aluminum matrix composite with the $TiB_2$ reinforcement particles, the aluminum matrix composite being used as a $TiB_2$ reinforcement particle-containing intermediate alloy; and step II: adding a weighed reaction mixed salt to an AA6111 melt sufficient to form 1% to 3% of a volume fraction of reinforcement particles ($ZrB_2$+$Al_2O_3$) in the ternary nanoparticle-reinforced aluminum matrix composite for a reaction, and applying the acousto-magneto coupling field during the reaction; after the reaction is completed, adding the $TiB_2$ reinforcement particle-containing intermediate alloy to obtain a resulting mixture, and subjecting the resulting mixture to incubation, standing, refining, slag removal, and casting to obtain an AA6111-based composite ingot, and subjecting the AA6111-based composite ingot to a T6 heat treatment to obtain the ternary nanoparticle-reinforced aluminum matrix composite, wherein the preparation method specifically comprises the following steps:

step 1: weighing borax, $KBF_4$, $K_2ZrF_6$, and $K_2TiF_6$ as reaction salts, and weighing an aluminum and an AA6111 aluminum alloy as matrices, wherein powders of the reaction salts are dried, the $KBF_4$ reaction salt and the $K_2TiF_6$ reaction salt are weighed at an amount enough to form a 5 wt. % $TiB_2$ reinforcement particle-containing intermediate alloy and thoroughly mixed to obtain a $KBF_4/K_2TiF_6$ mixed reaction salt powder, the $K_2ZrF_6$ reaction salt and the borax reaction salt are weighed at an amount sufficient to form 1% to 3% of a volume fraction of ($ZrB_2$+$Al_2O_3$) in the ternary nanoparticle-reinforced aluminum matrix composite and thoroughly mixed to obtain a $K_2ZrF_6$/borax mixed reaction salt powder, and the $KBF_4/K_2TiF_6$ mixed reaction salt powder and the $K_2ZrF_6$/borax mixed reaction salt powder are each wrapped with an aluminum foil for a later use;

step 2: preparation of the $TiB_2$ reinforcement particle-containing intermediate alloy: placing the weighed aluminum in a preheated crucible for melting by heating the weighed aluminum to 830° C. to 870° C., to obtain a resulting aluminum melt; adding the weighed $KBF_4/K_2TiF_6$ mixed reaction salt powder to the resulting aluminum melt, and after the weighed $KBF_4/K_2TiF_6$ mixed reaction salt powder is completely added, applying the acousto-magneto coupling field for a reaction conducted at 850° C. for 30 min; and after the reaction is conducted at 850° C. for 30 min to obtain a first melt, cooling the first melt to 730° C. to 750° C., subjecting the first melt to refining and slag removal, and casting with a copper mold to obtain a wedge-shaped ingot for a later use, which is the $TiB_2$ reinforcement particle-containing intermediate alloy;

step 3: preparation of the AA6111-based composite ingot: placing the weighed AA6111 aluminum alloy in a preheated graphite crucible for melting by heating the weighed AA6111 aluminum alloy to 830° C. to 870° C., to obtain a resulting AA6111 aluminum alloy melt; adding the weighed $K_2ZrF_6$/borax mixed reaction salt powder to the resulting AA6111 aluminum alloy melt, and after the weighed $K_2ZrF_6$/borax mixed reaction salt powder is completely added, applying the acousto-magneto coupling field for a reaction conducted at 850° C. for 15 min; after the reaction is conducted at 850° C. for 15 min to obtain a second melt, subjecting the second melt to refining and slag removal; after the second melt is cooled to 750° C., adding a weighed $TiB_2$ reinforcement particle-containing intermediate alloy to the second melt, wherein the $TiB_2$ reinforcement particle-containing intermediate alloy is weighed at an amount that allows a weight percentage of the $TiB_2$ in the AA6111-based composite ingot to be 1 wt. % to 3 wt. %; after the $TiB_2$ reinforcement particle-containing intermediate alloy is completely melted, applying the acousto-magneto coupling field, followed by incubating for 15 min to 20 min to obtain a third melt; subjecting the third melt to refining and slag removal, and then casting with a copper mold to obtain the AA6111-based composite ingot; and step 4: subjecting the obtained AA6111-based composite ingot to the T6 heat treatment, wherein the T6 heat treatment comprises a solid solution treatment and an aging treatment, wherein parameters of the acousto-magneto coupling field comprise: an excitation current of 200 A to 250 A; a magnetic field frequency of 15 Hz to 20 Hz; an ultrasonic power of 1.5 Kw to 2 Kw; and an ultrasonic frequency of 20 KHz to 30 KHz.

2. The preparation method of the in-situ ternary nanoparticle-reinforced aluminum matrix composite according to claim 1, wherein in the step 1, the powders of the reaction salts are dried at 200° C. to 250° C. for 2 h to 3 h.

3. The preparation method of the in-situ ternary nanoparticle-reinforced aluminum matrix composite according to claim 1, wherein in the step 2, in the $TiB_2$ reinforcement particle-containing intermediate alloy obtained after the casting, a proportion of the $TiB_2$ reinforcement particles is 5 wt %, with the balance being Al.

4. The preparation method of the in-situ ternary nanoparticle-reinforced aluminum matrix composite according to claim 1, wherein in the step 4, the solid solution treatment is conducted as follows: heating from a room temperature to a temperature of 545° C.-550° C., keeping at the temperature of 545° C.-550° C. for 2.5 h to 3 h, and then quenching in a water bath at a temperature not higher than 30° C., with a quenching transfer time of less than 10 s; and the aging treatment is conducted as follows: heating from room temperature to a temperature of 160° C.-180° C., keeping at the temperature of 160° C.-180° C. for 6 h to 8 h, and then furnace-cooling.

* * * * *